US007552690B1

(12) United States Patent
Chancey

(10) Patent No.: US 7,552,690 B1
(45) Date of Patent: Jun. 30, 2009

(54) BOBBIN EXTRACTOR

(76) Inventor: Roslyn Judith Chancey, 120 E. Oakland Park Blvd., Suite #105, Ft. Lauderdale, FL (US) 33334

( * ) Notice: Subject to any disclaimer, the term of this patent is extended or adjusted under 35 U.S.C. 154(b) by 297 days.

(21) Appl. No.: 10/947,862

(22) Filed: Sep. 23, 2004

Related U.S. Application Data

(60) Provisional application No. 60/505,663, filed on Sep. 24, 2003.

(51) Int. Cl.
*D05B 59/04* (2006.01)
*D05B 57/26* (2006.01)

(52) U.S. Cl. ..... 112/475.01; 112/186; 112/270

(58) Field of Classification Search ..... 112/1, 112/180, 270, 186, 228, 188, 181, 184, 185, 112/475.01; 81/53.2; 411/80.5, 80.6, 80.01; 242/118, 127

See application file for complete search history.

(56) References Cited

U.S. PATENT DOCUMENTS

| | | | | | |
|---|---|---|---|---|---|
| 434,650 | A | * | 8/1890 | Adams | 16/417 |
| 845,092 | A | * | 2/1907 | Jacob et al. | 112/180 |
| 906,987 | A | * | 12/1908 | Angus | 112/186 |
| 1,490,854 | A | * | 4/1924 | Rutter | 16/417 |
| 1,592,987 | A | * | 7/1926 | Mayer | 433/161 |
| 2,209,644 | A | * | 7/1940 | Colby | 16/433 |
| 2,420,536 | A | * | 5/1947 | Hohmann | 112/181 |
| 2,914,271 | A | * | 11/1959 | Staufert | 242/130.2 |
| 2,966,130 | A | * | 12/1960 | Johnson | 112/184 |
| 3,125,973 | A | * | 3/1964 | Bernerus et al. | 112/186 |
| 3,199,398 | A | * | 8/1965 | Weisz | 411/80.1 |
| 3,308,777 | A | * | 3/1967 | Gianinazzi | 112/186 |
| 3,854,673 | A | * | 12/1974 | Manning | 242/118.41 |
| 3,895,482 | A | * | 7/1975 | Schulz et al. | 57/275 |
| 3,898,896 | A | * | 8/1975 | Suhay | 81/441 |
| 4,155,519 | A | * | 5/1979 | Price | 242/118.41 |
| 4,189,628 | A | * | 2/1980 | Bitner | 200/33 R |
| 4,283,082 | A | * | 8/1981 | Tracy | 294/15 |
| 4,323,131 | A | * | 4/1982 | Allee | 175/413 |
| 4,377,956 | A | * | 3/1983 | Cooper | 81/444 |
| 4,724,608 | A | * | 2/1988 | Parrott | 29/724 |
| 4,872,291 | A | * | 10/1989 | Lindsey | 451/360 |
| 4,921,383 | A | * | 5/1990 | Fischer | 411/80.1 |
| 5,143,004 | A | * | 9/1992 | Mardix et al. | 112/186 |
| 5,301,703 | A | * | 4/1994 | Kahn | 135/77 |
| 5,848,316 | A | * | 12/1998 | Clough | 396/612 |
| 6,112,684 | A | * | 9/2000 | Papajewski | 112/185 |
| 6,676,349 | B1 | * | 1/2004 | Mey | 411/80.5 |
| 6,761,089 | B2 | * | 7/2004 | Bergamo | 81/53.2 |
| 6,986,317 | B2 | * | 1/2006 | Biehl, Sr. | 112/475.01 |
| 7,100,856 | B2 | * | 9/2006 | Murphy, Jr. | 242/118.41 |
| 2005/0188998 | A1 | * | 9/2005 | Salas | 132/212 |

FOREIGN PATENT DOCUMENTS

| | | | |
|---|---|---|---|
| DE | 19840956 | * | 2/2000 |
| GB | 856675 | * | 12/1960 |
| JP | 408059089 A | * | 4/1996 |

* cited by examiner

*Primary Examiner*—Ismael Izaguirre

(57) ABSTRACT

A device or tool having a protrusion, shaft or nubbin in a pre-determined size appropriate to be inserted into a hole of a bobbin, that when inserted presses against the walls of the hole, whereby which pressure is enough to allow the protrusion, shaft or nubbin to lift up the bobbin.

2 Claims, 1 Drawing Sheet

BOBBIN EXTRACTOR

CROSS-REFERENCE TO RELATED APPLICATIONS

Figure 1:
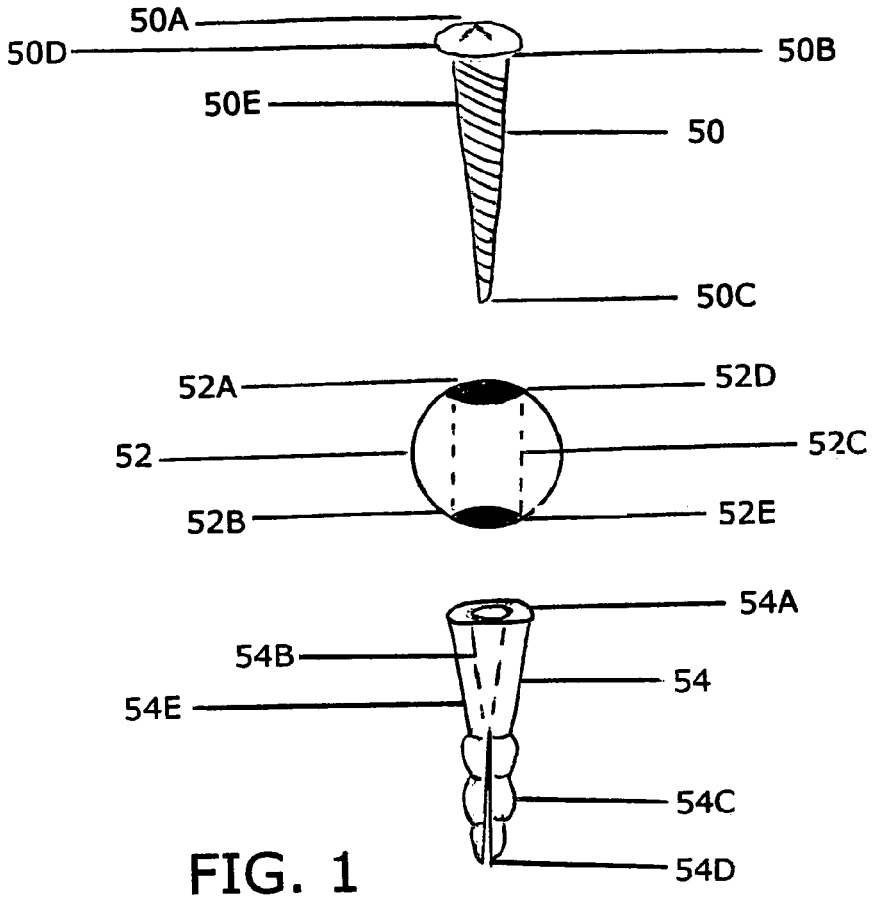

This application claims the benefit of PPA Ser. No. 60/505,663, filed 2003 Sep. 24. by the present inventor.

BACKGROUND

1. Field of Invention

This invention is in the field of hand-held tools for sewing, specifically relating to bobbin extractors.

2. Description of Prior Art

A sewing machine bobbin is a small item and sometimes very difficult to remove, depending on the make of the sewing machine, the size of one's fingers, the dexterity of one's hands and fingers, and the length of one's fingernails.

As late as the 1950's sewing machine advertisements were specifically addressed to the "housewife". Machines were being designed for the women, typically with small fingers and with adequate-length fingernails with which to remove a bobbin.

Many sewing machines produced about 50 to 100 years ago are still in operation today. Times have changed and today's men with large fingers and short fingernails often find it too difficult to remove a bobbin from these older sewing machines.

Even with the advances in today's sewing machines, where some models have incorporated a bevel to better allow a user's finger to reach in and lift the bobbin, it still remains difficult for those people with large fingers, and those people with arthritis.

Elna Sewing Machine Company in Switzerland is the only company that I know of who addressed the difficulty in removing a bobbin, with the introduction of their Star Series Sewing Machines in approximately 1964.

Elna incorporated a bobbin extractor device which was attached to the sewing machine. This device hung down from the machine behind the needle, and was positioned between the needle and the bobbin compartment, which bobbin compartment was also located behind the needle. The extractor had a nubbin facing downward, having 4 slits, to allow inward movement of the circumference of the nubbin as it pressed the walls of the bobbin's hole. Above the nubbin was attached a 4" spring, which spring was attached permanently inside the head of the sewing machine.

The problem with Elna's invention is that it could only be used with the particular machine to which it was attached.

What is needed in the art is a bobbin extractor device that is hand held and independent of a particular machine, which device can be used on "anmachine"—a machine—having a placed top-loading, drop-in bobbin. Such a device should be constructed in size small enough to fit behind and under the machine head, yet large enough for most people to be able to hold onto easily.

In the field of sewing and hand-held tools, prior art does not offer such a device.

OBJECTS AND ADVANTAGES

Several objects of my invention are:

(a) to provide a small hand-held device that is easy for one to use, no matter what size one's fingers are and no matter the dexterity of one's fingers and hands.

(b) to provide a device that can be used on a multiple of sewing machines.

(c) to provide a device that is easy to make with existing products, and therefore inexpensive to manufacture.

(d) to provide a device to make the work of sewing, easier for both home sewers and industrial sewers.

(e) to provide a device that is colorful to the eye and durable for years of service.

(f) to provide a device that a home sewer can make him or herself.

Several advantages of my bobbin extractor are:

(a) my bobbin extractor solves the problem of removing an empty bobbin easily, for one to be able to refill and replace the bobbin easily without frustration.

(b) my bobbin extractor can easily be made at home by a novice sewer.

(c) my bobbin extractor can be made in a multiple of colors appealing to the eye, to be easily spotted on the sewing table.

(d) my bobbin extractor is durable and should last in tact for years of use.

(e) my bobbin extractor can easily be transported in one's pocket for use at a different location.

(f) my bobbin extractor is versatile in that it can be used on multiple brands of sewing machines.

(g) my bobbin extractor is useful for persons of all ages and for persons having different finger and hand sizes.

(h) my bobbin extractor is useful for persons of all ages regardless of finger and hand dexterity.

Other objects and advantages will become apparent from the specification and drawings.

SUMMARY

For use on top-loading, drop-in-type sewing machine bobbins, a bobbin extractor has a protrusion, shaft or nubbin in a pre-determined appropriate size able to be inserted into a hole of a bobbin, that, when inserted, presses against the walls of said hole, causing pressure sufficient to allow the protrusion, shaft or nubbin to lift the bobbin out.

DRAWING FIGURES

FIG. 1 shows the layout of three components that comprise my bobbin extractor: a screw 50, a bead 52 and a wall anchor 54.

Figure 2:
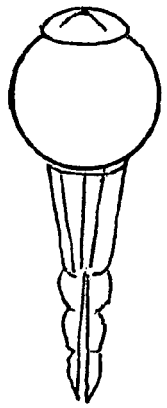

FIG. 2 shows three elements of my bobbin extractor assembled into one piece.

REFERENCE NUMERALS IN DRAWINGS

50—SCREW
50A—TOP OF SCREW HEAD
50B—UNDERSIDE OF THE HEAD OF THE SCREW
50C—TIP OF THE SCREW
50D—HEAD OF THE SCREW
50E—UPPER PART OF THE SCREW
52—BEAD
52A—TOP OF THE BEAD
52B—BOTTOM OF THE BEAD
52C—HOLE IN THE BEAD
52D—TOP OF THE HOLE IN THE BEAD
52E—BOTTOM OF THE HOLE IN THE BEAD
54—WALL ANCHOR
54A—TOP OF THE WALL ANCHOR
54B—CAVITY OF THE WALL ANCHOR

54C—PROTRUSION, SHAFT OR NUBBIN OF WALL ANCHOR

54D—TIP OF THE WALL ANCHOR

54E—UPPER PART OF THE WALL ANCHOR

DESCRIPTION

A bobbin extractor, comprising:

(a) a screw 50

(b) a bead 52 comprising:

(1) a hole in the bead 52C through the center of the bead, which hole enters at the top of the bead 52A and extends vertically to the bottom of the bead 52B, (c) a wall anchor 54, whereby the screw enters the top of the hole in the bead 52D, passes through the hole in the bead 52C and out the bottom of the hole in the bead 52E, and then at the top of the wall anchor 54A screws into the cavity of the wall anchor 54B, creating a hand-held device, with said device being able to be inserted into the hole of a bobbin and able to lift out the bobbin.

This invention can be made as one molded piece, or as two pieces, in different pre-determined sizes, in different pre-determined lengths, in different pre-determined colors and of different pre-determined materials as deemed appropriate.

The wall anchor is the only necessary piece to complete this invention, in itself qualifying as a new-use invention.

The wall anchor has a grasping area to be grasped by a user's fingers, and provides a protrusion, shaft or nubbin, whereby the user can insert the protrusion, shaft or nubbin into the bobbin hole to lift out the bobbin.

This invention may be better understood by reference to the accompanying drawings.

FIG. 1 shows (a) screw 50,
(b) top of screw head 50A
(c) underside of the head of the screw SOB
(d) tip of the screw 50C
(e) head of the screw 50D
(f) upper part of the screw 50E
(g) bead 52,
(h) top of the bead 52A
(i) bottom of the bead 52B
(j) hole in the bead 52C
(k) top of the hole in the bead 52D
(l) bottom of the hole in the bead 52E
(m) wall anchor 54,
(n) top of wall the anchor 54A
(o) cavity of the wall anchor 54B
(p) protrusion, shaft, nubbin of wall anchor 54C
(q) tip of the wall anchor 54D
(r) upper part of the wall anchor 54E whereby the screw 50 passes through the hole in the bead 52C and screws into the wall anchor 54, and a bobbin extractor device is created.

FIG. 2 shows bobbin extractor in three pieces, assembled.

FIRST EMBODIMENT

Preferred Embodiment

The First Embodiment comprises three elements: wall anchor 54, bead 52 and screw 50.

FIG. 1: Start with a wall anchor 54 which can be purchased from Closet Maid, 650 Southwest 27th Avenue, P.O. Box 4400, Ocala, Fla. 34478-4400, item number 650, which I found to be the perfect size to fit the hole of a sewing machine bobbin. The tip of the wall anchor 54D is split, which allows for adjusting the tip of the wall anchor 54D to fit most bobbins.

To add a larger grasping area for fingers, a 12 mm wood bead 52 already painted can be purchased from Cousin Corporation of America, 12333 Enterprise Blvd., Largo, Fla. 33773-2939. I found that the 12 mm pony bead 54 is best. The pony bead 54 has a hole in the bead 52C that is large, which eliminates the need to screw into the wood, which is considerably difficult to do. The large hole allows a screw 50 to freely pass through the hole in the bead 52C and secure into the cavity of the wall anchor 54B. The bead 52 will be held in place sandwiched between the underside of the head of the screw 50B and the top of the wall anchor 54A.

It is best to use a Phillip Pan screw 50 size 8×¾. This screw 50 can be obtained from Hillman Fastener, 10590 Hamilton Avenue, Cincinnati, Ohio 45231, item number 1070260. (I found that the larger size 8×⅞ screw 50, when used with a 12 mm bead 52, is too long for this particular no. 650 wall anchor 54 and should be avoided. Because the screw 50 is longer, in order to hold the bead 52 tightly against the top of the wall anchor 54A, the screw 50 must be screwed deeper into the cavity of the wall anchor 54B. When screwed deeper into the cavity of the wall anchor 54B, the wider diameter of the upper part of the screw 50E causes pressure on the upper part of the wall anchor 54E, which causes the wall anchor 54, in time, to rip apart.)

The three elements above: wall anchor 54, wooden bead 52, and screw 50 are assembled together to create the preferred embodiment of my bobbin extractor.

The bead 52 should be painted in an attractive color in a gloss paint which would be easy to wash if necessary. The head of the screw 50D should be painted to match the bead 52 in a durable gloss paint that has dried, prior to screwing into the wall anchor 54.

To assemble:

1. Place the painted head of the screw 50D through the painted hole in the bead 52C.
2. Place the wall anchor 54 under the bead 52 and using a screwdriver, screw the screw 50 into the wall anchor 54.

For added stability, and to keep the screw 50 tight to the wall anchor 54, I suggest that a dab of adhesive be placed on the underside of the head of the screw 50B and on the tip of the screw 50C, prior to screwing the screw 50 into the wall anchor 54.

SECOND EMBODIMENT

Second Embodiment comprises one element: wall anchor 54.

FIG. 1: Use a wall anchor 54 as described in said First Embodiment. The wall anchor 54, alone, as a new-use invention, is a sufficient tool with which to lift a bobbin out.

THIRD EMBODIMENT

The Third Embodiment comprises two elements: wall anchor 54 and screw 50.

FIG. 1: Said screw 50 is inserted into the cavity of the wall anchor 54B. If using Phillip Pan screw 50 size 8×¾, said screw 50 must be inserted into the cavity of the wall anchor 54B just part way, allowing 12 mm from the top of the wall anchor 54A to the underside of the head of the screw 50B, as if the 12 mm bead shown in said First Embodiment were included in position. If this distance is not allowed, the pressure of the screw 50 will rip the wall anchor 54.

A dab of adhesive should be placed on the tip of the screw 50C before inserting the screw 50 into the cavity of the wall anchor 54B.

FOURTH EMBODIMENT

The Fourth Embodiment comprises two elements: wall anchor 54 and a bead 52.

This embodiment is the same as the Second Embodiment with the addition of an item such as a bead 52 to be placed on the top of the wall anchor 54A to allow more substance to enable a user to more easily be able to grasp this device. I suggest that the item be 12 mm in height, and no more than 12 mm in width, such as a wood bead 52, that can be purchased already painted from Cousin Corporation "ofAmerica"—of America—, 12333 Enterprise Blvd., Largo, Fla. 33773-2939.

Said item should be attached to the top of the wall anchor 54A by use of an adhesive.

SUMMARY, RAMIFICATIONS AND SCOPE

Summary

My bobbin extractor is a small hand-held tool that enables a user, no matter the size of the user's fingers, nor the dexterity of the user's hands, to be able to easily lift out a bobbin from top loading, drop-in-type bobbin holders in sewing machines.

Ramifications and Scope

1. My bobbin extractor can be made in just one piece.
2. Various materials flexible enough to be able to press against the wall of the hole in the bobbin, causing pressure enough to be able to lift the bobbin out, can also be used.
3. The bobbin extractor can be made with a corresponding holder that would attach to the sewing machine to house the bobbin extractor when the bobbin extractor is not in use.
4. The bobbin extractor could be made with a means for connecting the bobbin extractor to another item such as a sewing machine.
5. The bobbin extractor could be made in a shape that is not intended to be held vertically. It could be made in the shape of a right angle or some other shape.
6. Different forms of a protrusion, shaft or nubbin can be used to fit the hole of a bobbin and have the ability to lift the bobbin out.
7. Different items in different shapes can be used in place of a bead 52 for a user to hold onto in lifting the bobbin out.

While different forms of a protrusion, shaft or nubbin can be used to fit the hole of a bobbin with the ability to lift the bobbin out, a split tip as shown in the wall anchor 54 is ideal. The split tip can be pulled away from the center of the wall anchor, in the event more pressure is needed to be able to lift up a particular bobbin.

While an item of any shape can be used for a user to hold onto while lifting the bobbin out, consideration should be given to the fact that a narrow bobbin extractor will have a better ability to be placed in a vertical position and not touch against the sewing machine, allowing the tip of the wall anchor 54D or protrusion, shaft or nubbin of the bobbin extractor, if intended to be held vertically, to be able to enter the hole of the bobbin at 0 degrees, and not on an angle.

If the bobbin extractor is to be made with more than one element, an adhesive should be used when attaching the elements to one another. I suggest that a dab of adhesive be placed on the underside of the head of the screw 50B to hold the screw 50 tight to the wood bead 52, and a dab of adhesive on the tip of the screw 50C when tightening the screw 50 into the cavity of the wall anchor 54B.

Although the description above contains many specificities, these should not be construed as limiting the scope of the invention, but as merely providing illustrations of some of the presently preferred embodiments of this invention.

Other embodiments of this invention will be apparent to those skilled in the art upon consideration of this specification or from practice of the invention disclosed herein. Various omissions, modifications, and changes to the principles and embodiments described herein may be made by one skilled in the art without departing from the true scope and spirit of the invention which is indicated by the following claims:

I claim:

1. A method for making a handheld device for lifting a bobbin from a position in a sewing machine, the method comprising the steps of:

providing a bead having a throughgoing hole;

providing a wall anchor having a first bobbin gripping end and a second hand holdable end with a longitudinal cavity substantially between the ends;

providing a screw and passing said screw through the throughgoing hole of the bead for increasing the hand holdable area of the device, and then passing the screw through the longitudinal cavity of the wall anchor for affixing the bead and screw onto the cavity of the wall anchor;

grasping the device and pressing the bobbin gripping end of the device against the walls of the bobbin hole for lifting the bobbin out.

2. A method of using a hand holdable device for lifting a bobbin from a position in a sewing machine, separate from the sewing machine, the method comprises the steps of:

providing a bead having a throughgoing hole;

providing a wall anchor having a first bobbin gripping end and a second grasping end with a longitudinal cavity substantially between the ends;

passing a screw through the throughgoing hole of the bead for increasing the hand holdable area of the device, and then passing the screw through the longitudinal cavity of the wall anchor for affixing the bead and screw onto the cavity of the wall anchor;

grasping the bead and grasping area of the wall anchor and inserting the bobbin engaging end into the bobbin hole, pressing the bobbin engaging end of the wall anchor onto the walls of the hole of the bobbin for anchoring and then lifting the bobbin from the sewing machine.

* * * * *